United States Patent [19]

Kopal et al.

[11] 3,949,572

[45] Apr. 13, 1976

[54] HIGH IMPACT KNITTING NEEDLE

[75] Inventors: Jaroslav Kopal, Liberec; Milos Jansa, Brno; Jaroslav Deiss, Tisnov, all of Czechoslovakia

[73] Assignee: Vyzkumny a vyvojovy ustav Zavodu vseobecneho strojirenstvi, Brno, Czechoslovakia

[22] Filed: July 29, 1974

[21] Appl. No.: 492,691

Related U.S. Application Data

[63] Continuation-in-part of Ser. No. 102,333, Dec. 29, 1970, abandoned.

[30] Foreign Application Priority Data

Dec. 29, 1969 Czechoslovakia ..... 8557-69

[52] U.S. Cl. ..... 66/115; 66/123

[51] Int. Cl.[2] ..... D04B 35/02

[58] Field of Search ..... 66/115, 123, 124, 107, 66/110

[56] References Cited

UNITED STATES PATENTS

| | | | |
|---|---|---|---|
| 433,747 | 8/1890 | Scott | 66/124 |
| 468,513 | 2/1892 | Gilbert | 66/124 X |
| 664,808 | 12/1900 | Dodge | 66/124 UX |
| 1,178,682 | 4/1916 | Scott | 66/124 |
| 1,221,806 | 4/1917 | Scott | 66/115 |
| 2,192,098 | 2/1940 | Page | 66/123 |
| 3,712,082 | 1/1973 | Kohorn | 66/124 X |

FOREIGN PATENTS OR APPLICATIONS

| | | | |
|---|---|---|---|
| 360,631 | 11/1931 | United Kingdom | 66/115 |

*Primary Examiner*—Mervin Stein
*Assistant Examiner*—Andrew M. Falik

[57] ABSTRACT

A shockless needle for circular knitting machines, wherein the needle is slidably mounted in a trick and is provided with a butt which periodically engages a needle-sliding cam. The butt extends radially from the needle in a direction at least substantially at right angles to the longitudinal axis of the needle. The needle or jack of the invention is provided at the location of the butt with a relief in order to decrease the thickness and thus the stiffness of the needle and also simultaneously increase the clearance between the butt portion and the confronting thick walls. In another embodiment, the walls of the trick of the knitting machine at the location confronting the needle butt are recessed in order to increase the clearance between the butt portion and trick walls and to provide space for the sidewise deflection of the needle when the needle is momentarily bent when its butt is engaged by the needle-sliding cam.

5 Claims, 5 Drawing Figures

HIGH IMPACT KNITTING NEEDLE

This application is a continuation-in-part of application Ser. No. 102,333, filed Dec. 29, 1970, now abandoned.

This invention relates to shockless needles for circular knitting machines and deals with the problem of reducing the impact force acting on the needle, caused by inertia and/or the entraining force of the yarn being knitted.

The conventional needles of the state of the art generally have the same thickness throughout. The needles are recessed in their lower parts for the purpose of springing the needle in the trick to obtain some resistance to avoid the needles falling out from the trick. The problem of impact shock is eliminated only if, in the place where the needle butt strikes the cam during the operation of the circular knitting machine, there is a certain angle, such angle depending upon experience. With regard to such constructions in these places there occurs a sudden increase of acting forces, and a local wear of the cam takes place. The latter occurs eventually in the place of maximum acceleration of the needle or due to the resistance raised by the yarn. This fact limits the increase in the output of circular knitting machines both from the point of view of actual output by the increase in the speed of revolution and as to the increase of the number of cam systems of the circular knitting machine.

The aforementioned disadvantages and shortcomings are, up to a certain degree, eliminated by this invention, the principle of which is that the needles, which are individually slidable in the tricks, are at the location of the butts provided with relief either in the needle, jacks or trick walls to increase the clearance between the butt portion of the needle or jack and the trick walls.

The advantage of shockless needles for circular knitting machines according to this invention is that they insure a decrease in the stress of the needle and of the cam trick, which permits decreasing the wear of both of the aforementioned parts. At the same time, this embodiment enables a substantial increase of the machine output either by increase of speed of the machine or by the increase of the number of cam systems in the machine.

Two exemplary embodiments of the invention are illustrated in the drawing, wherein.

Figure 1:
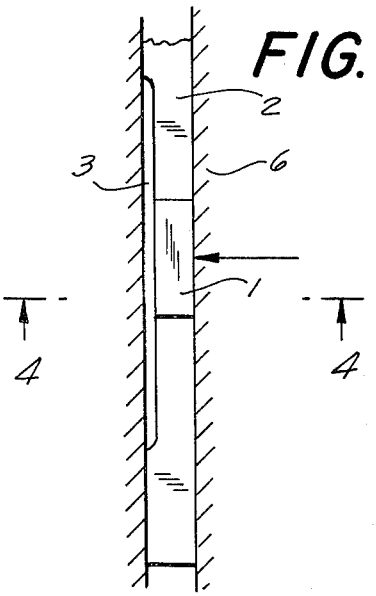
FIG. 1 is a front elevation of the needle being ground in the zone of the butt on the side other than that which strikes the cam.
Figure 2:
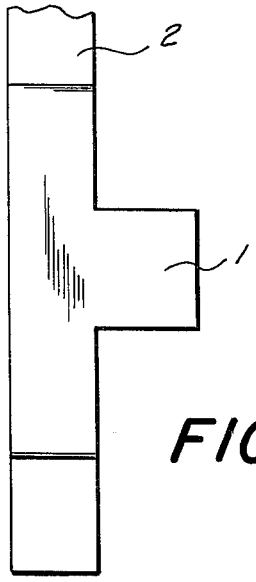
FIG. 2 is a side elevation of this needle.
Figure 4:
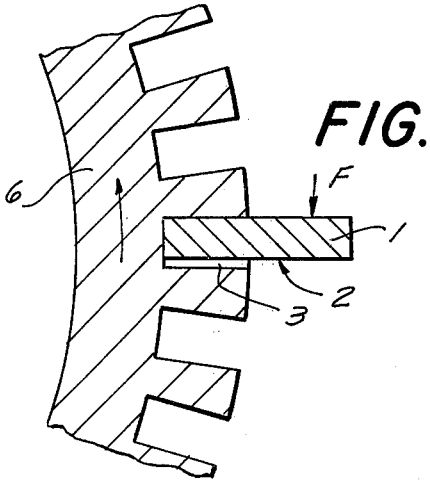
FIG. 4 is a schematic view in horizontal cross section along line 4—4 in FIG. 1 through a fragmentarily shown needle cylinder of a circular knitting machine having a needle therein formed as in FIG. 1.

Shockless needles for circular knitting machines constructed in accordance with the invention constitute a solution of the problem for decreasing the impact force F caused by inertia and/or the entraining force of the yarn. In a first embodiment shown in FIGS. 1 and 4, the location of an outwardly projecting integral butt 1 on the needle shank 2 is shown. The shank 2 exhibits a recess defining a zone of relief 3 in the trailing side, relative to the operational direction of the cylinder 6 of the circular knitting machine, of the needle shank 2.

Figure 3:
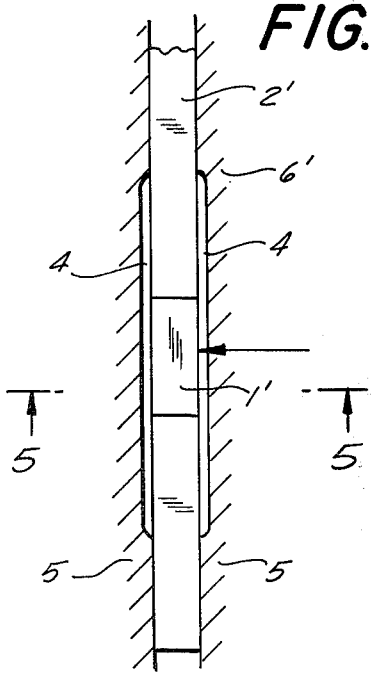
FIG. 3 is a front elevational view of a second embodiment of the invention wherein a spring position of the needle is illustrated in the recessed part of exchangeable trick walls in the zone of the butt.
Figure 5:
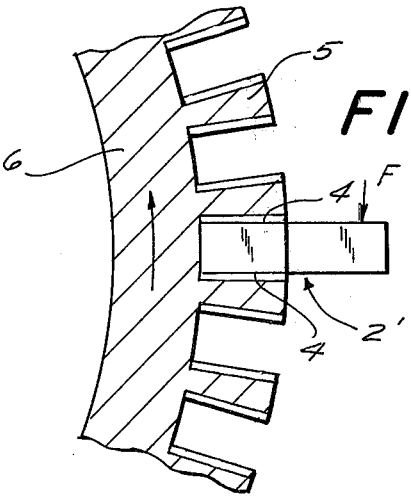
FIG. 5 is a view similar to FIG. 4 but with a needle therein formed as in FIG. 3, the section being taken along line 5 — 5 of FIG. 3.

In a second embodiment there is illustrated in FIGS. 3 and 5 a combined needle bed 6′ and a recess defining a zone of relief 4 which is located on both sides of the trick walls 5, which form the needle bed. This arrangement is shown in a circular knitting machine, although it may be applied to composed needle beds. The advantage of this embodiment resides in that the needle shank 2′ is not weakened, recess 4 in the exchangeable trick walls 5 can be located in both sides and this makes possible their use in knitting machines having reciprocatory motions as well as in circular knitting machines.

Shockless needles for circular knitting machines according to this invention can be advantageously used in the design of circular knitting machines enabling maximum decrease of the striking force acting on the needle during the machine operation. The aforedescribed constructions can also be used in flatbed knitting machines. In both cases it is possible to use the constructions of the invention also with other auxiliary elements such as sinkers, jacks, etc.

Although the invention is illustrated and described with reference to a plurality of preferred embodiments thereof, it is to be expressly understood that the invention is not limited to the disclosure of such a plurality of embodiments, but is capable of numerous modifications within the scope of the appended claims.

What is claimed is:

1. In a circular knitting machine having needles with elongated shanks slidably mounted in tricks in a needle carrier that is rotatable in a first angular direction, each of said needles having an outwardly protruding integral butt for engagement with needle sliding cams on the machine, an improved arrangement for reducing the impact forces in the needles when the associated butts engage one of said cams, wherein the needle carrier exhibits a plurality of relieved unobstructed zones individually defined between the trailing side of each needle relative to the first angular direction and the confronting side wall of the associated trick, each relieved zone being aligned and at least coextensive with the butt of the associated needle, whereby to provide an increased clearance between the trailing side of the needle and the confronting trick side wall and thus to permit unobstructed bending of the needle shank into said relieved zone when the butt engages one of said cams.

2. A machine as defined in claim 1, wherein for defining said zone of relief the trailing side of each needle is recessed along a portion thereof aligned and at least coextensive with the associated butt.

3. A machine as defined in claim 1, wherein for defining said zone of relief the confronting side wall of the trick is provided with a recess along a portion thereof aligned and coextensive with the butt on the associated needle.

4. In a circular knitting machine having needles with elongated shanks slidably mounted in tricks in a needle carrier rotatable in a first angular direction, each of said needles having an outwardly protruding integral butt for engagement with the needle sliding cams on the machine, an improved arrangement for reducing the impact forces in the needles when the associated butts engage one of said cams, wherein the opposed side walls of each trick respectively confronting the leading and trailing sides of the associated needle relative to the first angular direction exhibit opposed recesses which are aligned and at least coextensive with the butt on the associated needle.

5. In a circular knitting machine having needles slidably mounted in tricks in a needle carrier rotatable in a first direction, each of said needles having an elongated shank portion extending parallel to a first axis and an integral butt extending outwardly from the shank portion for engagement with needle sliding cams on the machine, an improved arrangement for reducing the impact forces in the needles when the associated butts engage one of said cams, wherein the needle carrier exhibits a plurality of relieved unobstructed zones individually defined between the trailing side of each needle shank, relative to the first angular direction, and the confronting side wall of the associated trick, each zone being aligned and at least coextensive with the butt of the associated needle, whereby to provide an increased clearance between the trailing side of the needle shank and the confronting side wall of the trick and thus to permit unobstructed bending of the needle shank into said relieved zone when the butt engages one of said cams.

* * * * *